United States Patent [19]

Henderson et al.

[11] 4,267,132

[45] May 12, 1981

[54] METHOD FOR HIGH STRENGTH DOUBLE BASE SOLVENTLESS GUN PROPELLANT

[75] Inventors: Larry D. Henderson, Bryans Rd.; Craig E. Johnson, Indian Head, both of Md.

[73] Assignee: The United States of America as represented by the Secretary of the Navy, Washington, D.C.

[21] Appl. No.: 475,331

[22] Filed: May 28, 1974

[51] Int. Cl.[3] ..... C06B 21/00

[52] U.S. Cl. ..... 264/3 B; 149/19.4; 149/98

[58] Field of Search ..... 264/3 B; 149/19.4, 98

[56] References Cited

U.S. PATENT DOCUMENTS

| | | | |
|---|---|---|---|
| 3,149,012 | 9/1964 | Preckel | 264/3 B X |
| 3,223,756 | 12/1965 | Goodyear et al. | 264/3 B |
| 3,361,689 | 1/1968 | Miegel et al. | 149/19.4 X |
| 3,673,287 | 6/1972 | Thies et al. | 102/103 X |
| 3,711,343 | 1/1973 | Dunigan et al. | 149/98 X |
| 3,855,373 | 12/1974 | Swotinsky et al. | 264/3 B |

*Primary Examiner*—Peter A. Nelson

*Attorney, Agent, or Firm*—R. S. Sciascia; A. L. Branning

[57] ABSTRACT

A method for manufacturing crosslinked double base propellants which includes compounding the propellant with no more than 0.1 weight percent of a crosslinking catalyst, partially curing the propellant by a mild heat prior to extrusion until the energetic binder is plasticized but not crosslinked, and extruding the propellant in a ram extruder at a temperature from 120° F. to 150° F. before the crosslinking mechanism has become too advanced for extrusion.

3 Claims, No Drawings

METHOD FOR HIGH STRENGTH DOUBLE BASE SOLVENTLESS GUN PROPELLANT

BACKGROUND OF THE INVENTION

This invention relates generally to solid propellant processing and in particular to processing extruded double base propellants.

Double base propellants are homogenous propellants containing a first energetic combustible plasticized by a second energetic combustible or a mixture of additional combustibles to form a plasticized energetic binder. Throughout this specification the first energetic combustible is referred to as the energetic binder, the second energetic combustible as the energetic plasticizer, and their combination as the plasticized energetic binder.

Oxidizers and metal fuels may be added to double base propellants. If an additional oxidizer(s) is added, the double base propellant is referred to as a modified double base propellant. A double base propellant with an additional oxidizer(s) and an additional metal fuel(s) is referred to as a composite modified double base propellant. Such propellant may have solids loading as high as 75 weight percent.

The term "plasticization" is synomous with gelatinization. It describes the initial reaction of the energetic binder with the energetic plasticizer. By this reaction, the binder and the energetic plasticizer form a soft colloidal dispersion.

In order to increase the mechanical strength of a propellant and prevent shape distortion during long storage, the plasticized energetic binder is crosslinked with a polyisocyanate compound which is termed the "crosslinker". The crosslinker is prepared by reacting two moles of a difunctional isocyanate with one mole of a difunctional hydroxy terminated material. To improve the crosslinking, a crosslinking catalyst is added.

The mechanism by which the freshly mixed propellant becomes usable for propellant purposes is termed "cure". The mechanism encompasses both the setting of the soft colloidal dispersion of the energetic binder and energetic plasticizer and the crosslinking of the crosslinker with the plasticized energetic binder. By curing the propellant becomes a tough elastic rubbery substance.

Until now the only known way of manufacturing crosslinked double base propellants has been the cast method. The major drawbacks of this method are the large tooling expenses, high labor costs, air entrapment problem, and worker exposure to explosions.

The importance of crosslinked double base propellants and the disadvantages associated with the cast method of preparation have generated a great interest in finding another method. Extrusion would be an excellent alternate method. The method would not require the use of expensive tooling for long periods of time or high labor costs. The method is semi-continuous as opposed to the batch operation of the cast method. Also the extrusion method can be operated by remote control, thereby avoiding exposure of the workers to the possibility of explosions. Unfortunately due to the difficulties presented by the simultaneous mechanisms of plasticization and crosslinking, the hardness requirements for the extruding material of an extruder, success has not been obtained with extrusion methods of preparation for crosslinked double base propellants.

SUMMARY OF THE INVENTION

Accordingly, an object of this invention is to provide a quasi-continuous process for manufacturing crosslinked double base propellants.

Another object of this invention is to provide an extrusion process for crosslinked double base propellants.

Another object of this invention is to reduce labor and tooling costs for crosslinked double base propellants.

A further object of this invention is to increase the safety of processing crosslinked double base propellant.

These and other objects are achieved by compounding a crosslinked double base propellant with no more than 0.1 weight percent of a crosslinking catalyst, partially curing the propellant at a temperature from 120° F. to 140° F. until the energetic binder has become plasticized, and extruding the partially curred propellant in a ram extruder at a temperature from 100° F. to 150° F. and at a rate from about 0.5 to about 6 ins/min. before the crosslinking mechanism has become too advanced for extrusion.

BRIEF DESCRIPTION OF THE PREFERRED EMBODIMENTS

The basis of the remarkable success of this invention are (1) compounding and partially curing the propellant in such a way that a lag is created between the plasticization and the crosslinking mechanisms, thereby making it possible to extrude the propellant after the energetic binder has been plasticized but before an appreciable amount of crosslinking has occurred. A number of factors have been discovered to be critical to producing this lag. It has been discovered that 0.1 weight percent of the crosslinking catalyst is the limit for this ingredient for the compositions contemplated for the present inventions. Extremely crucial to creating the needed lag is the balance between the time for and the amount of heat being applied during the preextrusion cure. For the crosslinking compounds to be used in the practice of the present invention, the curing temperature is from about 120° F. to about 140° F. and the resulting cure time would be from about 1 to about 4 days.

In order to determine the precise temperature and cure time for a particular formulation, the propellant is checked at intervals with a Shore Durometer or a similar device. The values obtained continuously increase to a certain point. At which point, the values level off. It is at this point the propellant must be extruded because soon after the hardness begins to increase due to the crosslinking mechanism. The plateau between the hardness increase produced primarily by plasticization and the hardness increase produced by crosslinking is generally not long.

For some formulation, the separation between the plasticization and crosslinking is slight. In order to avoid difficulties in extruding these formulations, an inert plasticizer may be added. Intricate central configurations, e.g., eight point star configuration may be extruded by using a teflon coated mandrel in the extruder.

The invention herein described is applicable to most double base propellants. The energetic binder may be nitrocellulose, plastisol nitrocellulose and the like. Due to the difficulty of plasticizing the energetic binder, before the crosslinking makes the propellant too viscous for extrusion, plastisol nitrocellulose (PNC) is the preferred as the energetic binder. The plastisol nitrocellulose (PNC) should have a nitrogen content of 11.6 to 13% and constitutes from about 30 to about 50 weight percent for double base propellants. With the higher solids loading double base propellants, i.e., modified double base and composite modified double base propellants, the amount of the energetic binder is from 7 to 35 weight percent of the total composition.

Examples of the energetic plasticizer are nitroglycerin (NG), trimethylolethane trinitrate (TMETN), diethyleneglycoldinitrate (DEGDN), mixtures thereof and the like. The amount of the energetic plasticizer may be from about 85 to 115% of the amount of the energetic binder.

While the crosslinker may be any isocyanate terminated compound made by reacting two moles of a difunctional isocyanate with one mole of a difunctional hydroxy terminated material such as polyoxyethyl ether or polyoxypropyl ethers, the preferred crosslinker is the reaction product of toluene diisocyanate with polyoxyethyl ether a polyoxypropryl or tetraethyleneglycol. The amount of this ingredient to be added in from about 1 to about 10 weight percent of the total composition.

In order to ensure consistent success with the broadest range of double base materials, an inert plasticizer should be included. Examples of inert plasticizers are dibutylphthalate (DBP) and dinormal propyl adipate (DNPA). The amount to be used is from about 1 to about 10 weight percent of the total composition.

Examples of solid additives which are often included are a metal fuel such as aluminum, oxidizers such as cyclotetramethylenetetranitramine (HMX) and ammonium perchlorate (AP), and ballistic modifiers such as lead salicylate and monobasic copper beta resorcylate. These additives may constitute up to about 75 weight percent of the total composition. This possibility of extruding a double base propellant with a solid loading up to 75 weight percent is one of the significant advantages of the present invention.

By way of example and not by limitation, the following process and test results are given. A mixture of 540.6 grams of plastisol nitrocellulose (PNC), 200 grams of heptane and 441.1 grams of trimethylethanetrinitrate (TMETN) was prepared in a 60LP ARC vertical mixer. The mixture was processed at 120° F. under vacuum. After 15 minutes, 200 additional grams of heptane were added to the mixture and processed at 120° F. under vacuum. After 15 minutes, 200 grams of heptane were added to the mixture and again processed at 120° F. under vacuum. After 30 minutes of processing, the pressure was recorded as 15 mm mercury (absolute pressure). An isocyanate terminated compound of tetraethylene glycol diisocyanate prepared by the method hereinafter described was heated to 100° F. and 95.8 grams of the prepolymer were added to the above mixture. The resulting mixture was processed at 100° F. for 10 minutes under vacuum in the same mixer. A solution of 34.2 grams of triethylene glycol dinitrate and 4.4 grams of ethyl centralite was vacuum degassed in a stainless steel beaker and added to the mixer. This mixture was then mixed at 90° F. for 20 minutes under vacuum. The completed mixture was poured into polyethylene containers. These were cured for 4 days at 130° F. The propellant was removed from the molds and easily extruded (i.e., at low pressure) from a 2-inch hydraulic ram press into one-quarter inch strands. The strands were soft and pliable.

A group of these strands was placed in an oven at 150° F. Samples were withdrawn periodically and tested for physical properties.

The results summarized in TABLE I were obtained.

TABLE I

| | Tensile Properties, strain rate 1.0 in./in./min. | | |
|---|---|---|---|
| Time at 150° F. Days | Maximum Stress psi | Elongation at Max. Strain, % | Young Modulus psi |
| 2 | 2820 | 30.45 | 51,672 |
| 2 | 2712 | 30.65 | 37,579 |
| 2 | 2526 | 22.04 | 37,579 |
| 6 | 2956 | 32.65 | 34,448 |
| 6 | 2857 | 35.66 | 29,527 |
| 6 | 2588 | 11.02 | 34,448 |

The polyisocyanate compound mentioned previously in the specific example was prepared in the following manner. In a 3000 ml 3 neck glass reactor, 1017.5 grams of toluene diisocyanate (TDI) was degassed 60 minutes under vacuum at 100° C. In a separate flask, 563.8 grams of tetraethyleneglycol was degassed 60 minutes under vacuum at 100° C. The reaction flask containing the TDI was purged with dry nitrogen and continuously stirred stirred while the tetraethyleneglycol was slowly added. The reaction mixture was cooled by immersing the reaction flask in a bath of water. During the 15 minute addition the reaction mixture was maintained between 90° and 105° C. After the addition cycle an electric heater maintained the temperature at 120° C. for 2 hours while the mixture was continuously stirred under a nitrogen purge.

Obviously many modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A method of preparing crosslinked double base propellants which comprises incorporating up to 0.1 weight percent of a crosslinking catalyst into the subsequently crosslinked double base propellant, partially curing the propellant at a temperature from about 120° F. to about 140° F. until the energetic binder has become plasticized, and extruding the propellant at a temperature from about 110° F. to about 150° F. at a rate from about 0.5 ins/min to about 6 ins/min after plasticization has occurred but before crosslinking has made the propellant too viscous for extrusion.

2. The method of claim 1 wherein an inert plasticizer is added to the propellant formulation.

3. The method of claim 1 wherein the propellant is extruded in an extruder having a teflon coated mandrel.

* * * * *